US005760754A

United States Patent [19]

Amero, Jr. et al.

[11] Patent Number: 5,760,754

[45] Date of Patent: Jun. 2, 1998

[54] LIGHT PIPE ASSEMBLY AND ELECTRICAL DEVICE USING SAME

[75] Inventors: Willard F. Amero, Jr., Flowery Branch; John E. Herrmann, Lawrenceville; Kevin J. Schechtel, Suwanee, all of Ga.

[73] Assignee: Motorola, Inc., Schaumburg, Ill.

[21] Appl. No.: 567,013

[22] Filed: Dec. 4, 1995

[51] Int. Cl.[6] ..... G09G 3/32

[52] U.S. Cl. ..... 345/82; 345/102; 349/62

[58] Field of Search ..... 345/102, 87, 74, 345/75, 76, 44, 82; 349/61, 62, 63, 64, 65, 56, 57, 58; 385/901

[56] References Cited

U.S. PATENT DOCUMENTS

| | | | |
|---|---|---|---|
| 3,980,811 | 9/1976 | Schaefer et al. | 385/901 |
| 3,994,564 | 11/1976 | Somogyi | 349/65 |
| 4,432,642 | 2/1984 | Tolles | 356/246 |
| 5,339,178 | 8/1994 | Phelps, III et al. | 349/62 |
| 5,396,350 | 3/1995 | Beeson et al. | 349/62 |

*Primary Examiner*—Xiao Wu

*Attorney, Agent, or Firm*—Scott M. Garrett; Felipe J. Farley

[57] ABSTRACT

A light pipe assembly (10) for an electrical device comprises a holder (12) made of a compliant material, and light pipes (14) which transmit light. The light pipes are seated in channels (16) formed in the holder. The holder has compressible ridges (22) formed on the portion of the holder where light enters (18). The light pipe assembly is seated in the device such that the light receiving face (34) of each light pipe is in proximity to a surface mounted LED (50). The compressible ridges keep light from bleeding from the LED to adjacent light pipes and compensates for the slight variations in dimensions between the housing (42) and the circuit board (44) of the device. The top portion (30) of each light pipe protrudes above the holder and through openings in the housing so that the signal of the LED can be seen.

11 Claims, 2 Drawing Sheets

LIGHT PIPE ASSEMBLY AND ELECTRICAL DEVICE USING SAME

TECHNICAL FIELD

This invention relates in general to electrical devices, and more particularly to visual indicator systems for electrical devices.

BACKGROUND

Electrical devices are made in a variety of forms from very simple devices, such as a flashlight, to sophisticated electronic computers. Many of these devices have visual indicators so that the operator of the device can tell which operating mode the device is in at a glance. Two types of visual indicators have come to market prominence. These are liquid crystal displays (LCDs) and light source displays, including lamps and light emitting diodes (LEDs).

In general, for portable electrical devices, the type of display used depends on the sophistication of the information to be indicated to the user. LCD displays cost significantly more, and require more circuitry than LED displays, but they consume much less power. LCD displays are preferred when the information displayed is complex, such as symbols and graphics. LED displays, and discrete LED indicators are cheap and simple to operate. For many devices, a small number of discrete LEDs is all that is required to indicate to the user what the device is doing.

A battery charger, for example, has only a few operating modes; charging, charging complete, fault, and idle are common operating modes of a battery charger. Many other devices have a similarly limited number of operating modes, and therefore use LEDs as indicators. Typically an LED is operated in one of three modes; off, on, or blinking. Variations of the blinking state could be used, such as slow and fast blink, but manufacturers typically don't use such variations because of the possibility of confusing the user.

As with most electrical components, discrete LEDs are available in leaded and leadless forms. The leadless form is commonly referred to as surface mounted. Typically when the circuitry used by a device is of one technology, either leaded or leadless, the LEDs are chosen to have the same mounting technology to avoid an additional assembly step. Both forms of LEDs require different assembly techniques. Leaded LEDs typically don't sit flush with the circuit board they are mounted on, but rather use their leads as standoffs so that they may protrude through an opening in the housing of the device where the user can see the top portion of the LED. The longer the leads of the LED are, the greater the tendency for them to get bent during assembly, and consequently, the greater the need for alignment during assembly.

Systems using surface mount LEDs, while not susceptible to bent leads, have a different challenge; getting the light from the LED to a point where the user can see it. The most common solution is the use of a light pipe. A light pipe is a transparent member which carries the light produced by the surface mounted LED to an opening in the housing of the device. One end of the light pipe is positioned over an LED and the other end is exposed through the device housing. Light produced by the LED is transmitted through the light pipe to the outside where a user can see the signal. To get the best transmission possible, the light pipe should be held close to the LED. However, in high volume manufacturing, the dimensional tolerances of the device housing, circuit board, light pipe, and LED make it impossible to have the light pipe contact the LED consistently during assembly of a large number of devices. At the same time, light from LEDs will bleed into adjacent light pipes, which may cause a misinterpretation by the user. Therefore there is a need for a light pipe assembly which allows for dimensional changes during high volume manufacturing of devices, and one whereby light bleed may be eliminated.

DETAILED DESCRIPTION OF THE PREFERRED EMBODIMENT

Figure 1:
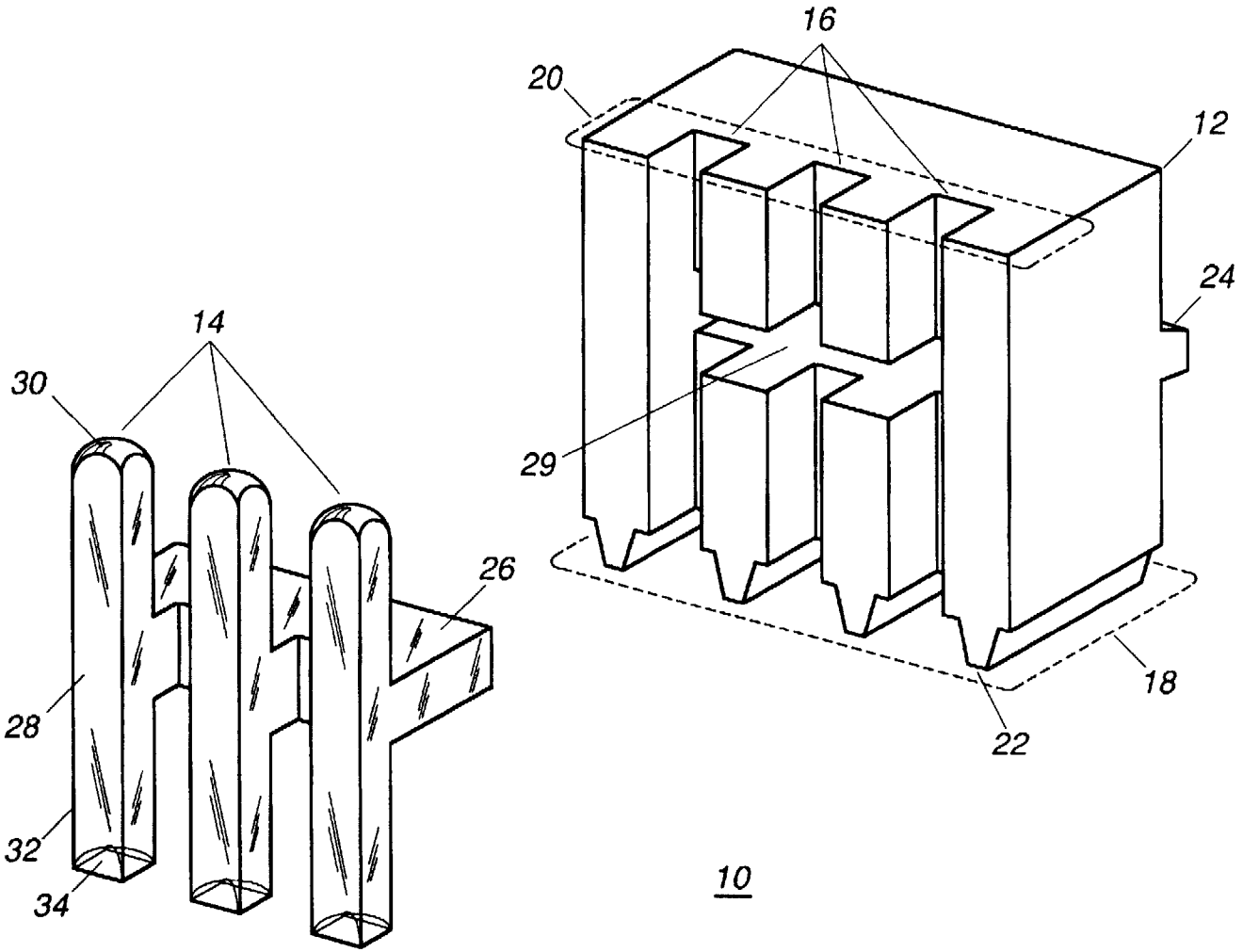
FIG. 1 is an exploded view of a light pipe assembly in accordance with the invention.

While the specification concludes with claims defining the features of the invention that are regarded as novel, it is believed that the invention will be better understood from a consideration of the following description in conjunction with the drawing figures, in which like reference numerals are carried forward.

Referring now to FIG. 1, an exploded view of a light pipe assembly 10 in accordance with the invention. There is shown therein a holder 12 and at least two, or a plurality of light pipes 14. The holder 12 holds the light pipes for assembly into an electrical device, and has a body fabricated from a compliant material such as, for example, rubber. The body of the holder has at least two, or a plurality of channels 16 formed through it which extend from an entry portion 18 to an exit portion 20, and correspond with the light pipes. Although shown here as grooves, it is contemplated that the channels may be in the form of tunnels through the body. The entry and exit portions are so named since it is intended that light will travel through the body by entering at the entry portion through the light pipes and exiting at the exit portion, although light will obviously travel in the opposite direction. The holder has at least one compressible ridge 22 protruding from the body disposed between the channels on the entry portion. This ridge separates the channels from each other. Further, the body of the holder is preferably formed with features, such as lip 24, for seating the holder into the housing of a corresponding electrical device.

The light pipes 14 are sized and shaped to correspond with the channels, and are disposed in the channels upon assembly, either by placement, or by having the holder overmolded around the light pipes. Preferably the light pipes are joined by a carrier strip 26, and the light pipes and carrier strip are integrally molded from transparent plastic. The carrier strip fits into a recess 29 formed in the holder. Each light pipe has an elongated body 28, a top portion 30, and a bottom portion 32. It is preferred that the top portion is domed and the bottom portion has a light receiving face 34 which is even with, or slightly recessed from the bottom portion of the holder and is preferably concave. It is also preferred that the top portions of the light pipes extend from the exit portion of the holder so that they can protrude through openings in the devices housing, as is discussed in greater detail hereinbelow.

In order to eliminate light bleed from one light pipe to another, three steps must be taken. The first, separating the light pipes with a light blocking material, is done by virtue of placing the light pipes in channels in the holder. The second step minimizes bleed through the carrier strip. The carrier strip is formed at about a right angle to the orientation of the light pipes, and the portion connecting each light pipe to the carrier strip extends from the light pipe at about a right angle to the orientation of the light pipe. By arranging the carrier strip and the connecting portions at right angels, light traveling from one light pipe to the next must make four sharp turns. Alternatively, the light pipes may not be joined by a carrier strip, and would be assembled into the holder individually. However, this would incur a handling cost during assembly. The third step uses the compressible ridges, as described in greater detail below.

Figure 2:
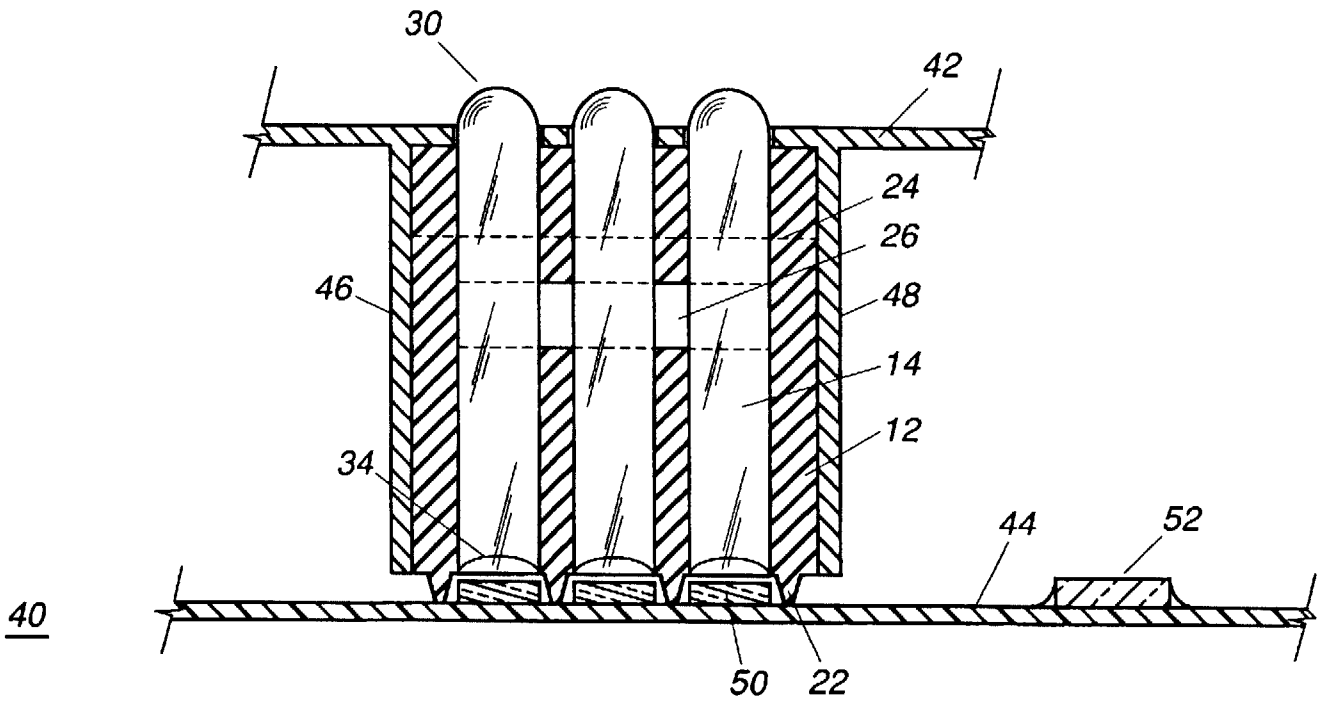
FIG. 2 is a cut-away side view of an electrical device having a light pipe assembly in accordance with the invention.

An appreciation of how the invention operates can be gained from a perusal of FIG. 2. Referring now to FIG. 2, there is illustrated therein a cutaway side view of an electrical device 40 having a light pipe assembly in accordance with the invention. The device comprises a housing 42 and a circuit board 44. The housing has openings formed therethrough to allow the top portion 30 of each light pipe to protrude to a point where it may be easily seen. The housing also has light pipe assembly receiving features such as first wall 46 and second wall 48 whereby the light pipe assembly is seated into the housing. The lip 24 can also be used as a seating feature as necessary.

The circuit board has light sources such as surface mount LEDs 50, and circuitry for controlling the LEDs, such as integrated circuit chip 52. The light pipe assembly is situated such that the compressible ridges 22 on the body of the holder contact the circuit board when the device is assembled. The ridges are designed so that they protrude far enough to make contact with the circuit board when the dimensional variations of the respective parts are such that the housing and the circuit board are furthest apart after assembly. At the same time, the assembly is designed so that the bottom face 34 of each light pipe is separated from the LED even when the dimensional variations are such that the circuit board and housing are closest after assembly. By dimensional variation, it is meant, as briefly described above, the small variations in dimensions of the various parts from one unit to the next. Small variations are typical for parts manufactured in large volumes, especially for molded plastic parts such as light pipes and device housings. By providing the compressible ridge(s) 22 between the LEDs, light from one LED cannot bleed into an adjacent light pipe. Additionally, since they are compliant and compressible, they allow for dimensional variations from one device to the next, whereas a non-compressible ridge would only fit if the housing and circuit board were always the same distance apart upon assembling the device. If the parts were too close together, there would be a fit problem, to far apart and light could bleed through the resulting gap. Therefore the invention eliminates light bleed between adjacent LEDs and light pipes, while allowing for the dimensional variations of high volume manufactured devices.

While the preferred embodiments of the invention have been illustrated and described, it will be clear that the invention is not so limited. Numerous modifications, changes, variations, substitutions and equivalents will occur to those skilled in the art without departing from the spirit and scope of the present invention as defined by the appended claims.

What is claimed is:

1. A light pipe assembly, comprising:

a holder having a body fabricated of compliant material and having an entry portion and an exit portion, a plurality of channels formed in said body, each said channel extending through said body from said entry portion to said exit portion, and at least one compressible ridge formed on said entry portion protruding from said body for separating said channels; and a plurality of light pipes, each said light pipe disposed in one of said channels, each said light pipe having an elongated body, a top portion, and a bottom portion, said bottom portion having a light receiving face wherein the lightpipes are initially separate from the holder and are only disposed in said channels upon assembly.

2. A light pipe assembly as defined in claim 1, wherein each said light receiving face is concave.

3. A light pipe assembly as defined in claim 1, wherein said light pipes are connected together by a carrier strip.

4. A light pipe assembly as defined in claim 1, wherein each said top portion of each said light pipe is domed.

5. A light pipe assembly as defined in claim 1, wherein said light pipe assembly is disposed in a housing for an electrical device, said housing having light pipe assembly receiving features, said body of said holder having features corresponding with said light pipe receiving features whereby said light pipe assembly is seated in said housing.

6. An electrical device, comprising:

a housing having openings formed therethrough;

a circuit board having light sources for providing light disposed thereon;

a light pipe assembly having a body fabricated of compliant material and having an entry portion and an exit portion, a plurality of channels formed in said body, each said channel extending through said body from said entry portion to said exit portion, at least one compressible ridge formed on said entry portion protruding from said body for separating said channels, a plurality of light pipes, each said light pipe disposed in one of said channels, each said light pipe having an elongated body with a top portion and a bottom portion, said bottom portion having a light receiving face; and wherein said top portions of said light pipes extend through said openings formed through said housing and each said light receiving face of said light pipes are each disposed over one of said light sources, and said compressible ridges contact said circuit board between said light sources to prevent said light provided by one said light source from bleeding into an adjacent light pipe wherein the lightpipes are initially separate from the holder and are only disposed in said channels upon assembly.

7. An electrical device as defined by claim 6, wherein said housing has light pipe receiving features, said body of said holder having features corresponding with said light pipe receiving features whereby said light pipe assembly is seated in said housing.

8. An electrical device as defined by claim 6, wherein each said light receiving face is concave.

9. An electrical device as defined by claim 6, wherein said light pipes are connected together by a carrier strip.

10. An electrical device as defined in claim 6, wherein each said top portion of each said light pipes is domed.

11. An electrical device as defined in claim 6, wherein said light sources are surface mounted LEDs.

* * * * *